US007152698B2

(12) United States Patent
Dewey

(10) Patent No.: US 7,152,698 B2
(45) Date of Patent: Dec. 26, 2006

(54) DOWNHOLE MOTOR LOCKING ASSEMBLY AND METHOD

(75) Inventor: Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 352 days.

(21) Appl. No.: 10/698,748

(22) Filed: Oct. 31, 2003

(65) Prior Publication Data

US 2004/0089480 A1 May 13, 2004

Related U.S. Application Data

(60) Provisional application No. 60/423,135, filed on Nov. 1, 2002.

(51) Int. Cl.
*E21B 4/00* (2006.01)

(52) U.S. Cl. ..... 175/107; 175/61

(58) Field of Classification Search ..... None
See application file for complete search history.

(56) References Cited

U.S. PATENT DOCUMENTS

| | | | |
|---|---|---|---|
| 3,896,667 A | 7/1975 | Jeter | |
| 4,705,117 A | 11/1987 | Warren et al. | |
| 5,911,275 A | 6/1999 | McGarian et al. | |
| 6,454,007 B1 | 9/2002 | Bailey | |
| 6,659,203 B1 * | 12/2003 | Cruickshank et al. | 175/107 |

FOREIGN PATENT DOCUMENTS

| | | |
|---|---|---|
| FR | 2332412 A | 6/1977 |
| GB | 2248792 A | 4/1992 |
| GB | 2353 332 A | 2/2001 |
| GB | 2378197 A | 2/2003 |
| WO | WO 02/02903 A1 | 1/2002 |

OTHER PUBLICATIONS

International Search Report for Application GB 0325404.2, Jan. 28, 2004, one page.
British Examination Report dated Jul. 6, 2005 for Appln. No. GB0325404.2, 1 pg.

* cited by examiner

*Primary Examiner*—Frank S. Tsay
(74) *Attorney, Agent, or Firm*—Conley Rose, P.C.

(57) ABSTRACT

A lockable motor assembly for use in a well bore comprises a stator, a rotor rotatably mounted within the stator, and a selectively removable flow restriction means. The lockable motor assembly may further comprise holding means for rotationally fixing the rotor to the stator. The flow restriction means limits the flow rate of fluid downstream of the rotor, thereby substantially balancing hydraulic pressure above and below the stator.

62 Claims, 5 Drawing Sheets

110
112
114
105
120
118
200
170
101
160
130
165
F
180
100
155
150
140
125

DOWNHOLE MOTOR LOCKING ASSEMBLY AND METHOD

CROSS-REFERENCE TO RELATED APPLICATIONS

The present application claims the benefit under 35 U.S.C. § 119(e) of U.S. Provisional Application Ser. No. 60/423,135 filed Nov. 1, 2002 and entitled "Downhole Motor Locking System and Method", hereby incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to downhole drilling motors and methods of operation. More particularly, the present invention relates to downhole motor locking assemblies having a flow restriction therein, and methods for selectively unlocking the assemblies.

BACKGROUND OF THE INVENTION

A downhole motor comprising a stator with a rotor rotatably mounted therein is often used during well bore operations to drive a rotating tool, such as, for example, a cutting tool designed to mill through casing and/or drill into a formation. Such downhole motors may be run into the well bore as part of a bottomhole assembly comprising other components positioned above and below the motor. Therefore, unless the rotor is "locked" to prevent it from rotating with respect to the stator, relative rotation of the bottomhole assembly components above and below the motor is possible. Such relative rotation is undesirable, for example, when bottomhole assembly components disposed below the motor must be properly oriented and anchored into place before milling or drilling commences.

For example, the downhole motor may be part of a sidetracking bottomhole assembly designed to drill a deviated, and sometimes horizontal, lateral well bore from a main well bore. One such sidetracking bottomhole assembly is shown and described in U.S. application Ser. No. 09/303,049, filed Apr. 30, 1999 and entitled "One-Trip Milling System", hereby incorporated herein by reference. A sidetracking bottomhole assembly may comprise, for example, a drilling assembly that includes a cutting tool, a whipstock, and a hydraulically settable anchor or packer all disposed below the motor. In operation, the sidetracking bottomhole assembly is lowered into the well bore, the whipstock is angularly oriented, and the anchor or packer is set. Then the cutting tool is rotated by the motor and guided along the whipstock while the drilling assembly moves downwardly within the main well bore. The whipstock has a ramped or sloped surface whereupon the cutting tool is deflected in the direction of the lateral well bore as the cutting tool moves downwardly. In a cased well bore, for example, the whipstock ramp urges the cutting tool radially outwardly so that the cutting surfaces of the tool engage the casing and mill a longitudinal window therethrough. The whipstock ramp further urges the cutting tool radially outwardly such that the cutting tool is positioned entirely outside of the well bore casing, thereby completing the window. The lateral well bore is drilled through this window, out into the formation.

Accordingly, to cut the casing window in the correct location, it is critical to properly angularly orient the whipstock in the main well bore so that the whipstock ramp faces in the desired direction. Then the hydraulically settable anchor or packer must be set to maintain the desired orientation of the whipstock. To hydraulically set the anchor or packer, drilling fluid is displaced through the bottomhole assembly, including the motor. This fluid displacement is likely to drive the motor during the setting procedure, which would thereby rotate the whipstock out of proper angular orientation. This drawback has seriously limited the use of downhole motors for such applications. Therefore, a need exists for a downhole motor assembly that may be temporarily "locked" as the bottomhole assembly is run into the well bore, oriented and set into position, and subsequently selectively "unlocked" for operation.

Further, although a low flow rate of fluid is sufficient for hydraulically setting an anchor or packer below the motor, the surface pumps may be designed to displace fluid at the drilling flow rate absent any flow restriction. Fluid displacement at the drilling flow rate will tend to drive an unlocked motor, and may be sufficient to unlock a temporarily locked motor. Therefore, a need exists for a downhole motor assembly that temporarily restricts the flow rate of fluid through the locked motor during the setting procedure.

SUMMARY OF THE INVENTION

The present invention relates to a lockable motor assembly for use in a well bore comprising a stator, a rotor rotatably mounted within the stator, and a selectively removable flow restriction means. In an embodiment, the lockable motor assembly further comprises a selectively releasable holding means for preventing rotation of the rotor with respect to the stator. In an embodiment, the holding means comprises a shear member. The holding means may be selectively released by differential pressure or by mechanical force. The assembly may further comprise a slot to allow removal of a portion of the holding means after release. In various embodiments, the restriction means comprises a nozzle, a tube, an orifice, a screen, a valve or a combination thereof The restriction means may be selectively removed by mechanical force. The assembly may further comprise a drive shaft disposed between the rotor and a device to be driven by the lockable motor assembly. In an embodiment, the assembly further comprises a nozzle disposed within a fluid passageway extending through the lockable motor assembly.

In another aspect, the present invention relates to a system for use in a well bore comprising a locked motor having a fluid passageway therethrough, the motor being selectively unlockable; and a selectively removable flow restriction means in fluid communication with the fluid passageway. In an embodiment, the flow restriction means prevents the locked motor from unlocking when a fluid flows through the fluid passageway. In various embodiments, the motor may be a PDM motor, a vane-type motor, or a turbine motor, and the motor may also have directional drilling capability.

In yet another aspect, the present invention relates to a system for drilling a lateral well bore from a main well bore comprising a locked downhole motor having a fluid passageway therethrough, the motor being selectively unlockable; a flow restriction means in fluid communication with the fluid passageway, the flow restriction means being selectively removable; a cutting tool operatively connected to the motor; a whipstock releasably connected to the cutting tool; and an anchor coupled to the whipstock. In various embodiments, the motor may be a PDM motor, a vane-type motor, or a turbine motor, and the motor may also have directional drilling capability. In an embodiment, the cutting tool comprises a PDC drill bit. The drill bit may be capable of milling through a casing in the main well bore and drilling the lateral well bore.

In still another aspect, the present invention relates to a method for drilling a lateral well bore from a main well bore comprising running an assembly including an anchor, a whipstock, a cutting tool, a locked motor, and a flow restriction means into the main well bore; orienting the whipstock while the motor is locked; setting the anchor while the motor is locked; selectively removing the flow restriction means; selectively unlocking the motor; and operating the motor to rotate the cutting tool to cut a window through a casing in the main well bore. In an embodiment, the method further comprises continuing to drill the lateral well bore with the cutting tool. In another embodiment, the method comprises directionally drilling a lateral well bore into the formation with the cutting tool. Further, the method may be performed in a single trip.

In yet another aspect, the present invention relates to a method of drilling a window through a casing in a well bore extending into a formation comprising running an anchor, a whipstock, a motor, a flow restriction means, and a cutting tool into the well bore; orienting the whipstock; flowing a fluid through the motor and the flow restriction means to create a first differential pressure sufficient to set the anchor without rotating the motor; selectively removing the flow restriction means; and flowing a fluid through the motor to create a second differential pressure sufficient to actuate the motor to rotate the cutting tool and cut the window. In an embodiment, the motor is locked at the first differential pressure and unlocked at the second differential pressure, and in another embodiment, the motor is selectively unlockable after the flow restriction means is removed.

In still another aspect, the present invention relates to a method of using a downhole motor within a well bore comprising running the downhole motor and a flow restriction means into the well bore; flowing a fluid through the motor and the flow restriction means to create a first differential pressure sufficient to operate a downstream device without rotating the motor; selectively removing the flow restriction means; and flowing a fluid through the motor to create a second differential pressure sufficient to operate the motor.

NOTATION AND NOMENCLATURE

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface and with "down", "lower", or "downstream" meaning toward the bottom of the main well bore or the lateral well bore.

DETAILED DESCRIPTION

Figure 1:
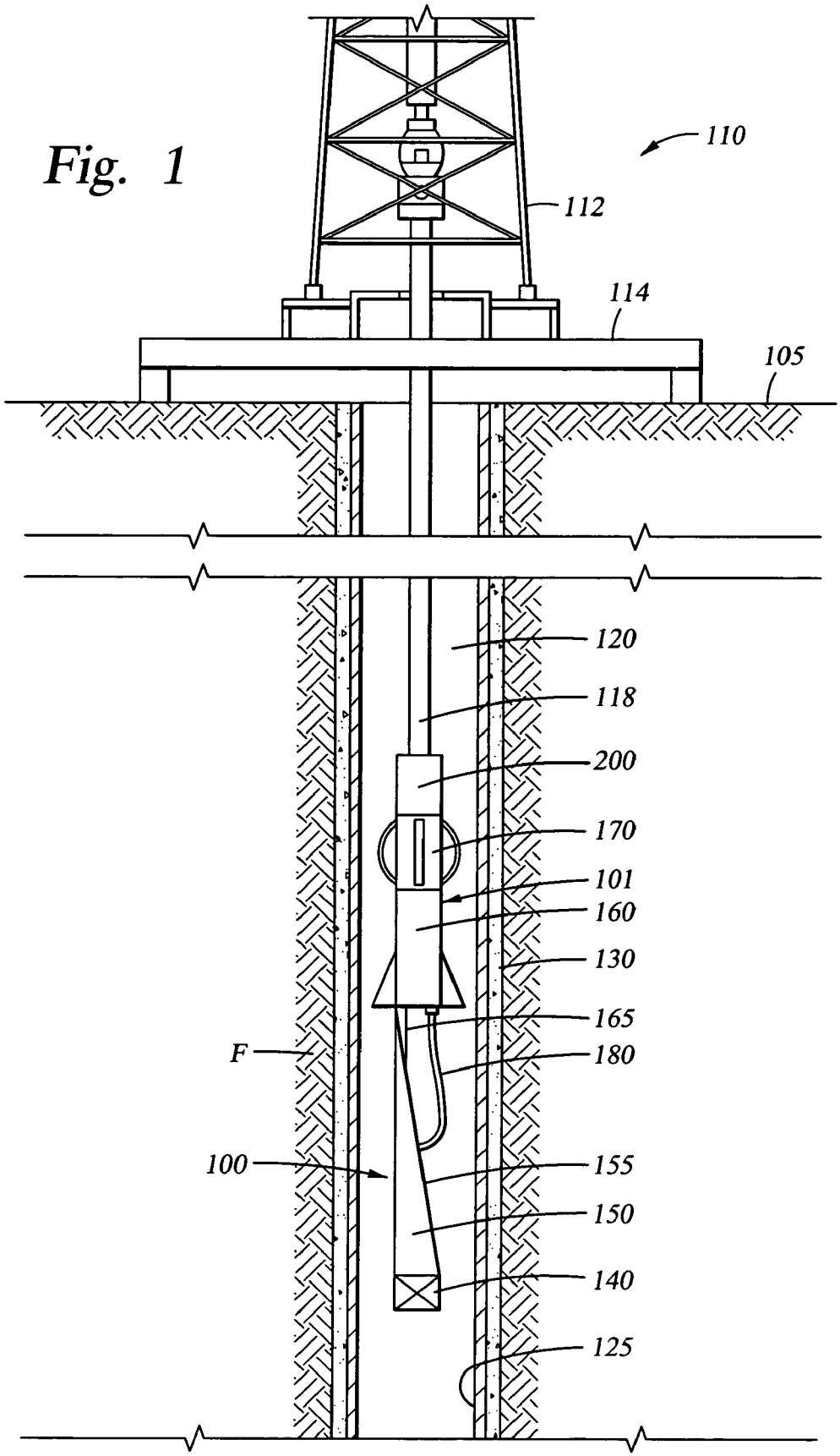
FIG. 1 is a schematic view, partially in cross-section, of an exemplary operating environment for a downhole motor locking assembly, depicting a bottomhole assembly being lowered within a well bore extending into a subterranean hydrocarbon formation.

FIG. 1 schematically depicts an operating environment for one embodiment of a downhole motor locking assembly, described in more detail below. As depicted, a drilling rig 110 is positioned on the earth's surface 105 adjacent a main well bore 120 that penetrates a subterranean formation F for the purpose of recovering hydrocarbons. At least the upper portion of the main well bore 120 may be lined with casing 125 that is cemented 130 into position against the formation F in a conventional manner. The drilling rig 110 includes a derrick 112 with a rig floor 114, and a drill string 118, such as jointed pipe, or coiled tubing, for example, extends downwardly into the well bore 120 through the rig floor 114. The drill string 118 suspends an exemplary sidetracking bottomhole assembly 100 as it is being lowered to a predetermined depth within the well bore 120 to perform the sidetracking operation. The drilling rig 110 is conventional and therefore includes a motor driven winch and other associated equipment for extending the drill string 118 into the wellbore 120 to position the bottomhole assembly 100 at the desired depth.

In sidetracking, an exit, such as a window, is cut into the casing 125 and then a lateral well bore is drilled through the exit at an angle to the main well bore 120. The bottomhole assembly 100 may take a variety of different forms. In the embodiment depicted in FIG. 1, which includes a downhole motor locking assembly, the bottomhole assembly 100 comprises an anchor 140, such as a bridge plug, packer or other setting device, connected to the lower end of a whipstock 150 having a tapered surface 155; a drilling assembly 101 releasably connected to the whipstock 150; and a flexible hose 180 connected between the drilling assembly 101 and the whipstock 150. In an embodiment, the drilling assembly 101 comprises a cutting tool 160, a stabilizer sub 170, and a motor 200. The cutting tool 160 releasably attaches to the upper end of the whipstock 150 by a frangible connection member 165, and the flexible hose 180 connects between the cutting tool 160 and the whipstock 150 to provide a fluid pathway for setting the anchor 140 or for performing other downstream functions. If the drilling assembly 101 will be used for directional drilling, the stabilizer sub 170 acts to concentrically retain the drilling assembly 101 within the main well bore 120. However, there may be applications where a stabilizer sub 170 is not required, and under such circumstances, a slick motor housing may be used instead. A locked motor 200 that is selectively unlockable is also operatively attached to the cutting tool 160. Additional components may be provided as part of the bottomhole assembly 100.

Figure 2:
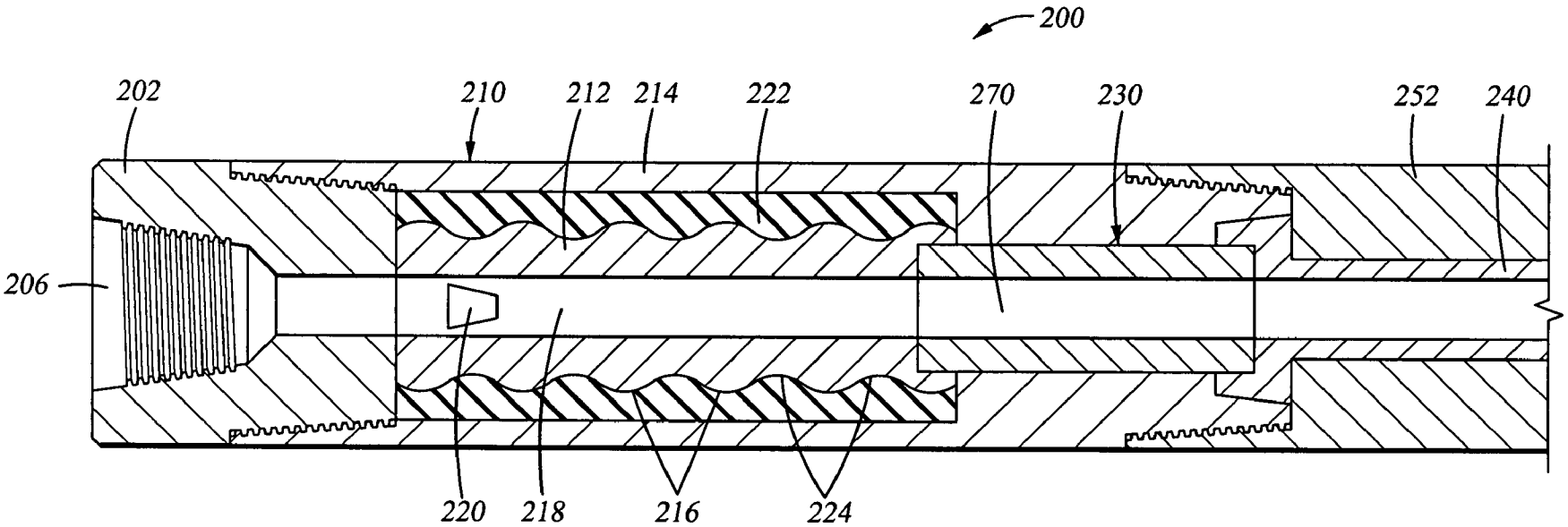
FIG. 2 is an enlarged cross-sectional side view of the upper portion of one embodiment of a downhole lockable motor.
Figure 3:
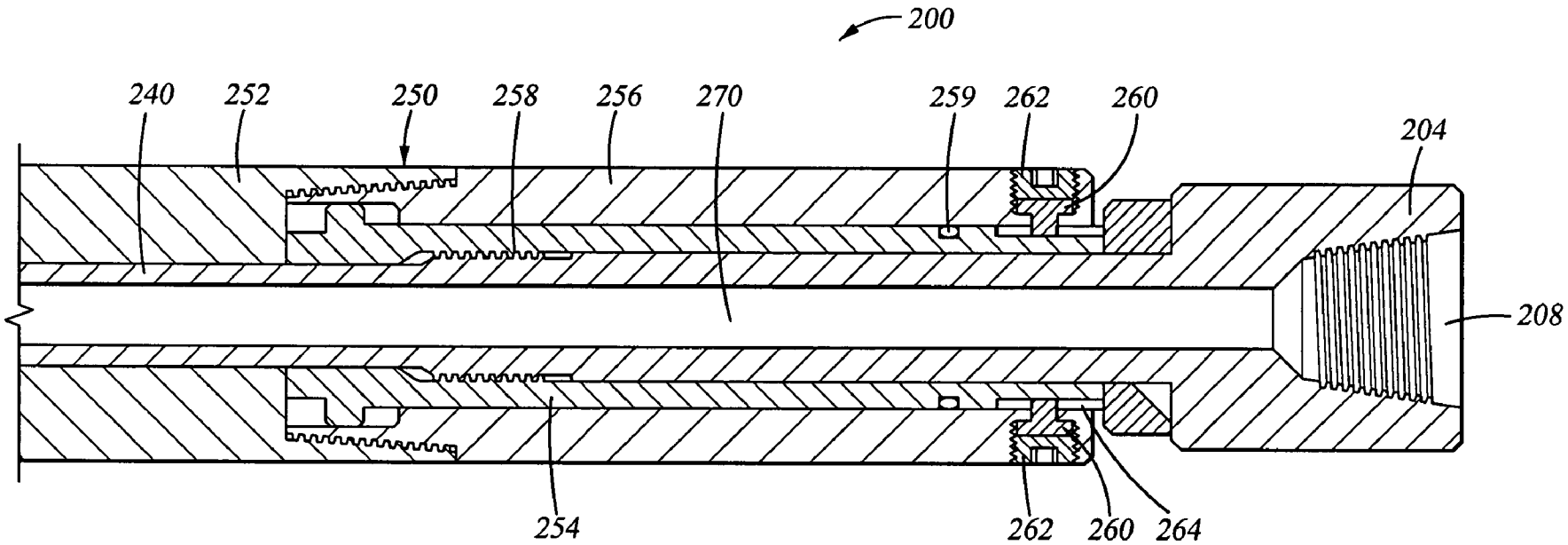
FIG. 3 is an enlarged cross-sectional side view of the lower portion of the downhole lockable motor of FIG. 2.

FIG. 2 and FIG. 3 depict enlarged cross-sectional side views of the upper and lower portions, respectively, of one exemplary downhole lockable PDM motor, generally designated as 200. As one of ordinary skill in the art will readily appreciate, the principles of the downhole motor locking assembly described herein may also be applied to other types of downhole motors, such as turbine motors or vane-type motors, for example. The PDM motor 200 is depicted in the locked position and comprises a power section 210, a coupling assembly 230, a drive shaft 240, a bearing assembly 250, holding means 260, and a fluid passageway 270 that extends from an upper end 202 of the motor 200 to a lower end 204 of the motor 200. API connectors 206, 208 are provided at the ends 202, 204 of the motor 200, respectively, for connecting the motor 200 to other components, such as the drill string 118 on the upper end 202 and the stabilizer sub 170, the cutting tool 160 or another drilling assembly 101 component on the lower end 204.

The power section 210 is the portion of the motor 200 that converts hydraulic horsepower into mechanical horsepower to drive the cutting tool 160 and comprises a rotor 212 rotatably mounted within an outer stator 214. The rotor 212 is shaped into a helix forming multiple lobes 216 and may have an axial bore 218 therethrough in fluid communication with the fluid passageway 270 to transmit hydraulic pressure to a device located below the motor 200, such as the anchor 140, for example. In an embodiment, a nozzle 220 is disposed within the axial bore 218 of the rotor 212. The nozzle 220 is typically sized to allow adequate fluid flow through the axial bore 218 to set the anchor 140, for example, but also to restrict the rate of fluid flow once the motor 200 is unlocked and operational. If the motor 200 was a turbine or vane-type motor, for example, that allows flow therethrough even in the locked position, an axial bore 218 through the rotor 212 may not be required to set the anchor 140, but nonetheless may be desirable to allow fluid flow through the locked motor 200 for other functions, such as cooling the cutting tool 160 or for cuttings removal, for example.

The stator 214 is a tubular member lined with an elastomer compound 222 that is shaped in a helix formed into lobes 224 that mate with the lobes 216 of the rotor 212. The type of elastomer compound 222 can vary depending on drilling fluid type and temperatures in the well bore 120. The number of stator lobes 224 typically exceeds the number of rotor lobes 216 by one. Generally, more lobes 216, 224 yield higher torque and slower speed while fewer lobes 216, 224 yield higher speed and lower torque.

The coupling assembly 230 is attached between the rotor 212 and the drive shaft 240. When the motor 200 is unlocked and operational, the coupling assembly 230 transmits rotational torque and speed from the rotor 212 to the drive shaft 240 to rotate the cutting tool 160. The coupling assembly 230 also converts the eccentric motion of the rotor 212 to the concentric motion of the drive shaft 240.

As depicted in FIG. 3, the drive shaft 240 is supported by the bearing assembly 250, which in turn transmits thrust and rotational power to the cutting tool 160. A bearing housing 252 connects to the stator 214 and to outer radial bearings 256, enclosing inner radial bearings 254. In an embodiment, the inner radial bearings 254 form a threaded connection 258 with the drive shaft 240. The bearing assembly 250 may be sealed or normally open. If the bearing assembly 250 is normally open, it may be desirable to provide temporary sealing of the bearings 254, 256 when setting a tool located below the motor 200, such as the anchor 140, for example. The temporary bearing seals may, for example, be O-ring seals 259 which are rapidly destroyed upon rotation of the inner radial bearings 254 relative to the outer radial bearings 256.

Holding means 260 are provided to lock the drive shaft 240, and thus releasably rotationally fix the rotor 212 of the motor 200 with respect to the stator 214. In an embodiment, the holding means 260 extend between the inner radial bearings 254 and outer radial bearings 256, and are held in by pipe plugs 262. The holding means 260 may include one or more shear elements, such as, for example, one or more shear pins or a shear ring that will shear when a predetermined force is applied. In an embodiment, as depicted in FIG. 3, the holding means 260 is a shear pin. A slot 264 may also be provided to allow removal of a portion of the holding means 260 once it has sheared to unlock the motor 200.

Figure 4:
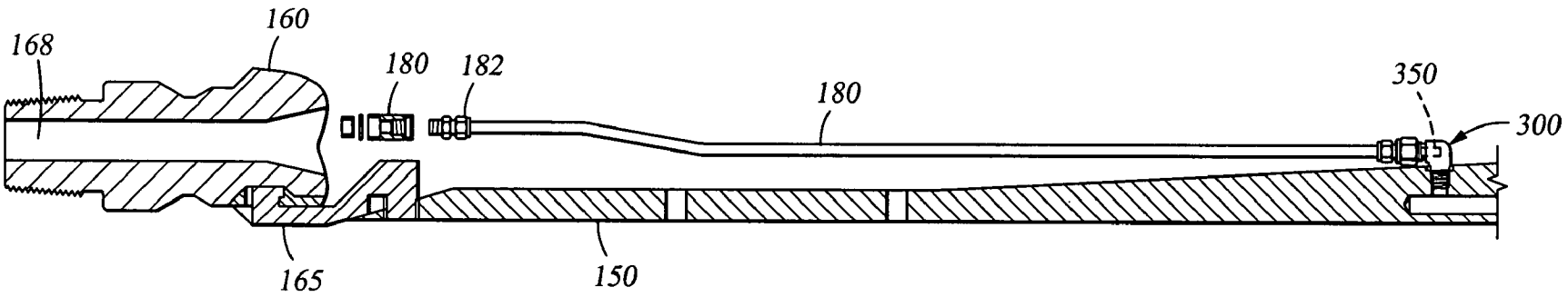
FIG. 4 is a cross-sectional partial side view of an embodiment of a cutting tool and a whipstock adapted for a downhole motor locking assembly.

Referring now to FIG. 4, a cross-sectional schematic view is depicted of one exemplary cutting tool 160 releasably connected by a frangible connection member 165 to an exemplary whipstock 150. As previously described, the cutting tool 160 may be connected directly to the motor 200 or may be separated from the motor 200 by a stabilizer sub 170 or other drilling assembly 101 components. In an embodiment, the cutting tool 160 is a PDC mill capable of milling a window through the casing 125 in the main well bore 120 as well as drilling into the formation F. The flexible hose 180 connects at its upper end to the cutting tool 160 by way of a connector 182 and hose adapter 184, thereby establishing fluid communication between a flow bore 168 in the cutting tool 160 and the flexible hose 180. The flexible hose 180 is connected at its lower end to the whipstock 150 by way of a fitting 300 comprising a restriction means 350, described in more detail with respect to FIG. 5. The cutting tool flow bore 168 is in fluid communication with the fluid passageway 270 in the motor 200, such that the flexible hose 180 provides a fluid pathway for setting the anchor 140 or for performing other downstream functions before the holding means 260 has been released. Thus, when the bottomhole assembly 100 is being run into the well bore 120 with the motor 200 locked, fluid pressure may be applied through the flexible hose 180 to set the anchor 140.

Figure 5:
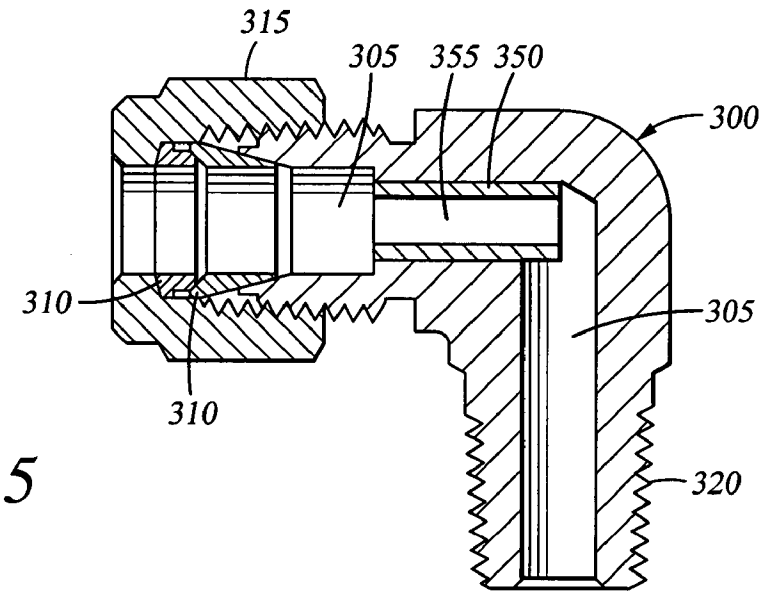
FIG. 5 is an enlarged cross-sectional side view of a fitting with one embodiment of a restriction means disposed therein adapted for a downhole motor locking assembly.

FIG. 5 depicts an enlarged, cross-sectional side view of one exemplary fitting 300 for connecting the flexible hose 180 to the whipstock 150 as part of the downhole motor locking assembly. As one of ordinary skill in the art will appreciate, the fitting 300 may take a variety of different forms. In one embodiment, the fitting 300 is L-shaped as shown with ferules 310 and a nut 315 for connecting to the flexible hose 180 and threads 320 for connecting to the whipstock 150. The fitting 300 includes an interior flow passage 305 that allows fluid pressure to be communicated to bottomhole assembly 100 components positioned below the whipstock 150, such as the anchor 140, for example.

A selectively removeable restriction means 350 may be disposed within the interior flow passage 305 of the fitting 300. In an embodiment, the restriction means 350 is a cylinder having a small inner diameter 355 that restricts the flow rate of fluid through the interior flow passage 305. Because the interior flow passage 305 is in fluid communication with the flexible hose 180, the flow bore 168 of the cutting tool, and the fluid passageway 270 through the motor 200, the restriction means 350 restricts the flow rate of fluid through the entire bottomhole assembly 100. In an embodiment, the restriction means 350 provides a greater flow rate restriction than the nozzle 220 disposed within the axial bore 218 of the rotor 212, and the restriction means 350 is sized to provide a sufficient fluid flow rate therethrough to set the anchor 140, for example. Operationally, the restriction means 350 serves to substantially balance the hydraulic pressure above and below the stator 214 of the locked motor 200 by limiting the flow rate through the axial bore 218 of the rotor 212. The restriction means 350 also ensures that the holding means 260 does not prematurely shear when fluid pressure is applied to set the anchor 140 or other tools located below the locked motor 200. As one of ordinary skill in the art will readily recognize, the restriction means 350 may comprise a wide variety of structures, such as, for example, a nozzle, a tube, an orifice, a screen, a valve, or a combination thereof. Further, while the restriction means 350 is depicted within the fitting 300, the restriction means 350 may be located anywhere downstream of the rotor 212 to thereby substantially balance the hydraulic pressure above and below the stator 214. By way of example, an alternative restriction means 350 may consist of a nozzle contained within the hose adapter 184 connecting the flexible hose 180 to the cutting tool 160. In another embodiment, the restriction means 350 may comprise a remotely operable flow control valve that partially closes to create the restriction and fully opens to remove the restriction.

In operation, while the sidetracking bottomhole assembly 100 is lowered into the main well bore 120 by the drill string 118 as shown in FIG. 1, and subsequently while the whipstock 150 is oriented and the anchor 140 is set, the motor 200 is locked. In an embodiment, the bottomhole assembly 100 is lowered onto a well reference member that has previously been installed at a predetermined location in the cased main well bore 120 for subsequent well operations. An exemplary well reference member is shown and described in PCT Application No. PCT/US01/16442 filed May 18, 2001 entitled "Well Reference Apparatus and Method", hereby incorporated herein by reference. The ramped surface 155 of the whipstock 150 is then oriented by conventional methods in the desired direction of the lateral well bore that will be drilled so that the cutting tool 160 can mill a window in the casing 125. Once the whipstock 150 is properly oriented, drilling fluid may be pumped through the drill string 118 and into the bottomhole assembly 100 to set the anchor 140. During the setting procedure, the flow rate and therefore the differential pressure of the drilling fluid is controlled by the restriction means 350. The holding means 260 should be designed such that the force required to shear it is substantially higher than any torsional forces created by the differential pressure required to set the anchor 140, thereby ensuring that the motor 200 does not unlock prematurely. Once the anchor 140 is set, and the set is confirmed by applying a vertical load to the anchor 140, the motor 200 may be unlocked.

To unlock the downhole motor 200, the restriction means 350 must be removed, and the holding means 260 must be released. Removing the restriction means 350 may be accomplished, for example, by raising the drilling assembly 101 within the well bore 120 to shear the frangible connection member 165 and thereby disconnect the cutting tool 160 from the whipstock 150. Raising of the drilling assembly 101 will also break the connection between the cutting tool 160 and the flexible hose 180, thereby effectively removing the restriction means 350 from the fluid flow path. Once the restriction means 350 is removed, the fluid flow rate and therefore the differential pressure in the motor 200 can significantly increase until a sufficient force is generated to shear the holding means 260 and thereby unlock the rotor 212 from the stator 214. In the alternative, the holding means 260 may be sheared by temporarily wedging the cutting tool 160 between the upper end of the whipstock 150 and the casing 125 and rotating the drill string 118, thereby applying the torsional force necessary to shear the holding means 260. The slot 264 allows for a portion of the holding means 260 to drop out of the bearing assembly 250 once it has sheared to unlock the motor 200. The rotor 212 is then free to rotate within the stator 214 to actuate the motor.

As the flow rate and hydraulic pressure of the drilling fluid flowing through the drilling assembly 101 increases, the motor 200 is actuated to rotate the cutting tool 160. The ramped surface 155 of the whipstock 150 deflects the cutting tool 160 toward the interior surface of the casing 125 as the drilling assembly 101 is lowered in the well bore 120. The whipstock ramp 155 urges the cutting tool 160 radially outwardly so that the cutting surfaces of the tool 160 engage the casing 125 and mill a longitudinal window therethrough. The whipstock ramp 155 further urges the cutting tool 160 radially outwardly such that the cutting tool 160 is positioned entirely outside of the well bore casing 125, thereby completing the window.

Figure 6:
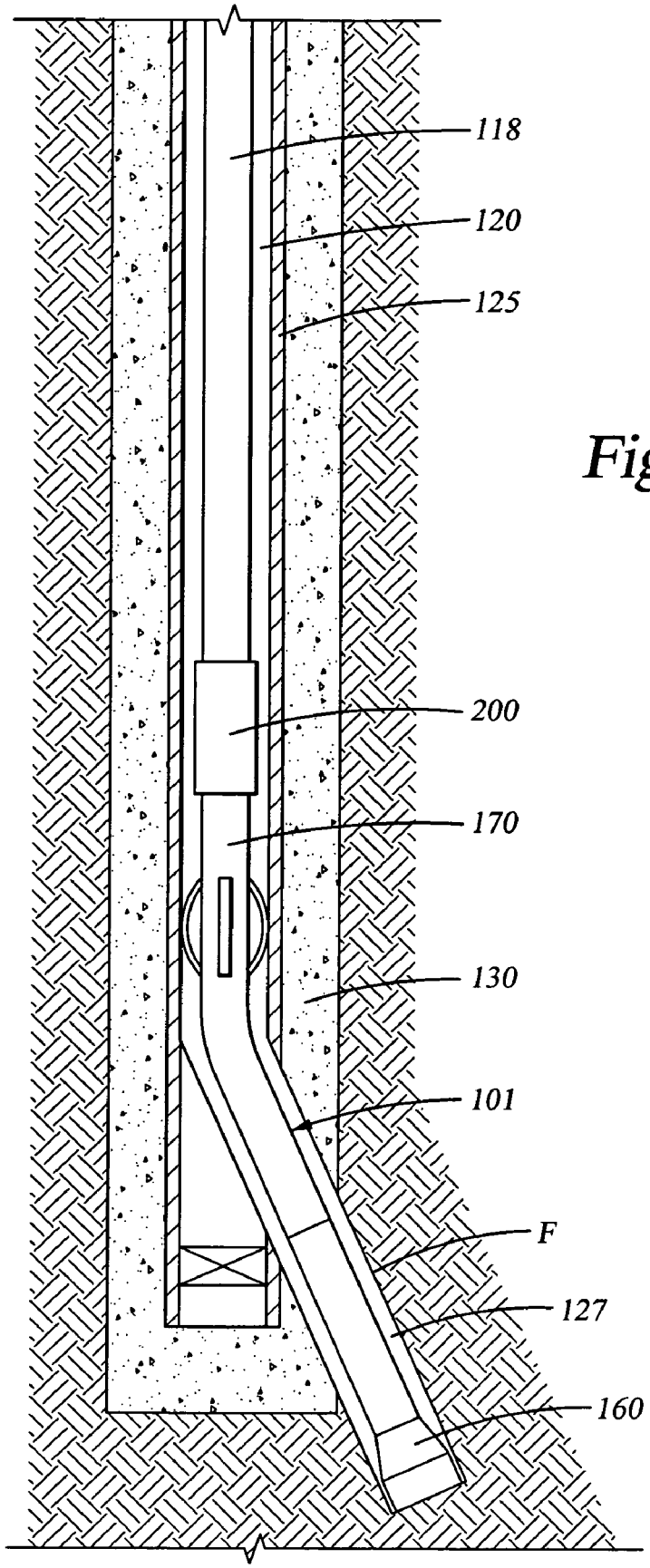
FIG. 6 is a schematic, cross-sectional side view of an exemplary operating environment depicting a cutting tool cutting a window through casing in a main well bore.

FIG. 6 is a schematic, cross-sectional side view depicting the cutting tool 160 cutting a window through the casing 125. Once the window has been cut, the cutting tool 160 may continue to drill through the cement 130 surrounding the casing 125 and then drill a rat hole 127 to begin the lateral well bore, as depicted. Thus, the bottomhole assembly 100 may be lowered, oriented, set into position, and the cutting tool 160 may be used to cut a window in the casing 125 and drill a rat hole to begin the lateral well bore all in a single trip into the main well bore 120.

In one embodiment, the cutting tool 160 continues drilling beyond the rat hole and into the formation F. If the cutting tool 160 is a PDC mill, or another type of cutting tool designed to mill casing and drill formation, the drilling assembly 101 may be used to continue drilling the lateral well bore to the desired depth. In an embodiment, the motor 200 also has directional drilling capability. Accordingly, all the steps necessary to drill a lateral well bore, or to directionally drill a lateral well bore, may be completed in a single trip into the main well bore 120.

Once drilling operations are complete, the drilling assembly 101 may be pulled to the surface. When the motor 200 is at the surface, it can be reset to the locked position by replacing the holding means 260 and the restriction means 350 as part of a new downhole motor locking assembly.

The foregoing descriptions of specific embodiments of the downhole motor locking assembly including downhole motor 200, holding means 260, and restriction means 350, as well as the systems and methods for drilling a lateral well bore from a main well bore 120 were presented for purposes of illustration and description and are not intended to be exhaustive or to limit the downhole locking assembly and methods to the precise forms disclosed. Obviously many other modifications and variations are possible. In particular, the type of bottomhole assembly 100, or the particular components that make up the bottomhole assembly 100 may be varied. Further, the type of motor 200, the type of holding means 260, the type of restriction means 350, and the type of cutting tool 160 may be varied. For example, the motor 200 could comprise a turbine type or a vane-type motor. The restriction means 350 could comprise a remotely operable control valve that partially closes to create the restriction and fully opens to remove the restriction. Many other variations are possible.

Accordingly, while various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. The different teachings of the embodiments discussed herein may be employed separately or in any suitable combination to produce desired results. Accordingly, the scope of protection is not limited by the description set out above, but is defined by the claims which follow, that scope including all equivalents of the subject matter of the claims.

What is claimed is:

1. A lockable motor assembly for use in a well bore comprising:

a stator;

a rotor rotatably mounted within said stator; and a selectively removable flow restriction means;

wherein said flow restriction means substantially balances hydraulic pressure above and below said stator.

2. The lockable motor assembly of claim 1 further comprising a fluid passageway therethrough.

3. The lockable motor assembly of claim 2 wherein said fluid passageway extends through said rotor.

4. The lockable motor assembly of claim 2 wherein said flow restriction means is in fluid communication with said fluid passageway.

5. The lockable motor assembly of claim 4 wherein said flow restriction means allows a fluid flow rate therethrough sufficient to operate at least one downstream device without rotating said rotor.

6. The lockable motor assembly of claim 2 further comprising a nozzle disposed within said fluid passageway.

7. The lockable motor of claim 4 further comprising a selectively releasable holding means for preventing rotation of said rotor with respect to said stator.

8. The lockable motor assembly of claim 7 wherein said flow restriction means prevents release of said holding means when a fluid flows through said fluid passageway.

9. The lockable motor assembly of claim 7 wherein said flow restriction means allows a fluid flow rate therethrough sufficient to operate at least one downstream device without releasing said holding means.

10. The lockable motor assembly of claim 7 wherein said holding means is selectively released by a predetermined differential pressure.

11. The lockable motor assembly of claim 1 wherein said flow restriction means is selectively removed by a mechanical force.

12. The lockable motor assembly of claim 1 wherein said flow restriction means comprises a nozzle, a tribe, an orifice, a screen, a valve or a combination thereof.

13. The lockable motor assembly of claim 1 further comprising a drive shaft disposed between said rotor and a device to be driven by said lockable motor assembly.

14. The lockable motor of claim 1 further comprising a selectively releasable holding means for preventing rotation of said rotor with respect to said stator.

15. The lockable motor assembly of claim 14 wherein said holding means is selectively released by a mechanical force.

16. The lockable motor assembly of claim 14 wherein said holding means is selectively released by a predetermined differential pressure.

17. The lockable motor assembly of claim 14 wherein said holding means comprises a shear member.

18. The lockable motor assembly of claim 14 further comprising a slot to allow removal of a portion of said holding means after release.

19. A system for use in a well bore comprising:

a locked motor having a fluid passageway therethrough; said motor being selectively unlockable; and a selectively removable flow restriction means in fluid communication with said fluid passageway;

wherein said locked motor is selectively unlockable after said flow restriction means is removed.

20. The system of claim 19 wherein said flow restriction means prevents said locked motor from unlocking when a fluid flows through said fluid passageway.

21. The system of claim 19 wherein said locked motor is selectively unlocked by flowing a fluid through said fluid passageway after said flow restriction means is removed.

22. The system of claim 19 wherein said locked motor is selectively unlocked by a mechanical force.

23. The system of claim 19 wherein said flow restriction means is selectively removed by a mechanical force.

24. The system of claim 19 wherein said flow restriction means allows a fluid flow rate therethrough sufficient to operate at least one downstream device.

25. The system of claim 24 wherein said downstream device is a hydraulically settable anchor or packer.

26. The system of claim 19 wherein said restriction means comprises a nozzle, a lube, an orifice, a screen, a valve or a combination thereof.

27. The system of claim 19 wherein said motor is a PDM motor, a vane type motor, or a turbine motor.

28. The system of claim 19 wherein said motor has directional drilling capability.

29. The system of claim 19 further comprising a cutting tool operatively connected to said motor.

30. The system of claim 29 wherein said cutting tool comprises a PDC drill bit.

31. The system of claim 29 wherein said cutting tool comprises a drill bit capable of milling through a casing and drilling into a formation.

32. The system of claim 29 further comprising a nozzle disposed within said fluid passageway.

33. A system for drilling a lateral well bore from a main well bore comprising:

a locked downhole motor having a fluid passageway therethrough; said motor being selectively unlockable;

a flow restriction means in fluid communication with said fluid passageway; said flow restriction means being selectively removable;

a cutting tool operatively connected to said motor;

a whipstock releasably connected to said cutting tool; and an anchor coupled to said whipstock;

wherein said flow restriction means is disposed downstream of said motor.

34. The system of claim 33 wherein said flow restriction means prevents said downhole motor from unlocking when a fluid flows through said fluid passageway.

35. The system of claim 33 wherein said flow restriction means allows a fluid flow rate therethrough sufficient to set said anchor without unlocking said motor.

36. The system of claim 33 wherein said motor is a PDM motor, a vane-type motor, or a turbine motor.

37. The system of claim 33 wherein said motor has directional drilling capability.

38. The system of claim 33 wherein said cutting tool comprises a PDC drill bit.

39. The system of claim 33 wherein said cutting tool comprises a drill bit capable of milling through a casing in said main well bore and drilling said lateral well bore.

40. The system of claim 33 wherein said locked motor, said flow restriction means, said cutting tool, said whipstock, and said anchor may be run into said main well bore in one trip.

41. The system of claim 33 wherein said flow restriction means is disposed within a fitting connected to said whipstock.

42. A method for drilling a lateral well bore from a main well bore comprising:

running an assembly including an anchor, a whipstock, a cutting tool, a locked motor, and a flow restriction means into the main well bore;

orienting the whipstock while the motor is locked;

setting the anchor while the motor is locked;

selectively removing the flow restriction means;

selectively unlocking the motor; and operating the motor to rotate the crating tool to cut a window through a casing in the main well bore.

43. The method of claim 42 further comprising continuing to drill the lateral well bore with the cutting tool.

44. The method of claim 43 wherein running the assembly, orienting the whipstock, setting the anchor, selectively removing the flow restriction means, selectively unlocking the motor, operating the motor to rotate the cutting tool to cut the window, and drilling the lateral well bore occurs in a single trip.

45. The method of claim 42 further comprising directionally drilling the lateral well bore with the cutting tool.

46. The method of claim 45 wherein running the assembly, orienting the whipstock, setting the anchor, selectively removing the flow restriction means, selectively unlocking the motor, operating the motor to rotate the cutting tool to cut the window, and directionally drilling the lateral well bore occurs in a single trip.

47. The method of claim 42 further comprising flowing a fluid through the motor while setting the anchor.

48. The method of claim 42 wherein selectively unlocking the motor comprises selectively releasing a holding means.

49. The method of claim 48 wherein selectively releasing the holding means comprises increasing a differential pressure within the motor to a predetermined value.

50. The method of claim 48 wherein selectively releasing the holding means comprises applying a mechanical force to the motor.

51. The method of claim 42 wherein running the assembly, orienting the whipstock, setting the anchor, selectively removing the flow restriction means, selectively unlocking the motor; and operating the motor to rotate the cutting tool to cur the window occurs in a single trip.

52. A method of drilling a window through a casing in a well bore extending in to a formation comprising:

running an anchor, a whipstock, a motor, a flow restriction means, and a cutting tool into the well bore;

orienting the whipstock;

flowing a fluid through the motor and the flow restriction means to create a first differential pressure sufficient to set the anchor without rotating the motor;

selectively removing the flow restriction means; and flowing a fluid through the motor to create a second differential pressure sufficient to actuate the motor to rotate the cutting tool and cut the window.

53. The method of claim 52 further comprising continuing to drill a lateral well bore into the formation with the cutting tool.

54. The method of claim 52 further comprising directionally drilling a lateral well bore into the formation with the cutting tool.

55. The method of claim 52 wherein the motor is locked at the first differential pressure and unlocked at the second differential pressure.

56. The method of claim 55 wherein the motor is selectively unlockable after the flow restriction means is removed.

57. A method of using a downhole motor within a well bore comprising:

running the downhole motor and a flow restriction means into the well bore;

flowing a fluid though the motor and the flow restriction means to create a first differential pressure sufficient to operate a downstream device without rotating the motor;

selectively removing the flow restriction means; and flowing a fluid though the motor to create a second differential pressure sufficient to operate the motor.

58. The method of claim 57 wherein the motor is locked at the first differential pressure and unlocked at the second differential pressure.

59. The method of claim 58 wherein the motor is selectively unlockable after the flow restriction means is removed.

60. The method of claim 58 wherein the motor is unlocked by releasing a holding means.

61. The method of claim 58 further comprising flowing a fluid through the motor to create a third differential pressure sufficient to unlock the motor.

62. The method of claim 58 further comprising applying a mechanical force to the motor sufficient to unlock the motor.

* * * * *